US009136601B2

(12) United States Patent
Yang

(10) Patent No.: US 9,136,601 B2
(45) Date of Patent: Sep. 15, 2015

(54) TUNABLE MULTIBAND WAN ANTENNA FOR GLOBAL APPLICATIONS

(71) Applicant: Motorola Solutions, Inc., Schaumburg, IL (US)

(72) Inventor: Guangli Yang, Bellport, NY (US)

(73) Assignee: MOTOROLA SOLUTIONS, INC., Schaumburg, IL (US)

( * ) Notice: Subject to any disclaimer, the term of this patent is extended or adjusted under 35 U.S.C. 154(b) by 325 days.

(21) Appl. No.: 13/904,413

(22) Filed: May 29, 2013

(65) Prior Publication Data

US 2014/0354495 A1 Dec. 4, 2014

(51) Int. Cl.
*H01Q 1/24* (2006.01)
*H01Q 9/06* (2006.01)

(52) U.S. Cl.
CPC . *H01Q 9/06* (2013.01); *H01Q 1/243* (2013.01)

(58) Field of Classification Search
CPC ..... H01Q 9/06; H01Q 9/42; H01Q 1/243; H01Q 1/24; H01Q 1/241; H01Q 1/244
USPC ..... 343/702, 750, 700 MS, 751
See application file for complete search history.

(56) References Cited

U.S. PATENT DOCUMENTS

| | | | | |
|---|---|---|---|---|
| 6,114,996 | A | 9/2000 | Nghiem | |
| 6,456,249 | B1 | 9/2002 | Johnson | |
| 7,345,634 | B2 | 3/2008 | Ozkar | |
| 7,696,928 | B2 | 4/2010 | Rowell | |
| 8,094,079 | B2 | 1/2012 | Schlub | |
| 8,169,374 | B2 | 5/2012 | Hill | |
| 2007/0200766 | A1 | 8/2007 | McKinzie | |
| 2008/0266190 | A1 | 10/2008 | Ohba | |
| 2009/0121948 | A1 * | 5/2009 | Nysen | 343/702 |
| 2010/0245177 | A1 | 9/2010 | Jagielski | |
| 2012/0068893 | A1 * | 3/2012 | Guterman et al. | 343/702 |
| 2012/0302188 | A1 | 11/2012 | Sahota | |
| 2013/0249764 | A1 * | 9/2013 | Amaya et al. | 343/845 |
| 2014/0266922 | A1 * | 9/2014 | Jin et al. | 343/702 |

FOREIGN PATENT DOCUMENTS

| | | | |
|---|---|---|---|
| EP | 2405534 | A1 | 1/2012 |
| WO | 2010070636 | A1 | 6/2010 |

* cited by examiner

*Primary Examiner* — Hoanganh Le
(74) *Attorney, Agent, or Firm* — Barbara R. Doutre

(57) ABSTRACT

An electronic device includes an antenna for a transceiver to operate in a plurality of frequencies. The antenna includes a first portion that is coupled to an elongate element and is configured to enable the transceiver to operate in a first low-band frequency and a first high-band frequency. A second portion is also coupled to the elongate element. The second portion is configured to enable the transceiver to operate in a second high-band frequency. A third portion is coupled to the elongate element and is situated between the first and second portions. The third portion is configured to tune the first and the second high-band frequencies associated with the first and second portions. A tuning element is configured to tune the low-band frequency associated with the first portion such that the first and the second high-band frequencies are not significantly affected by tuning the tuning element.

20 Claims, 12 Drawing Sheets

TUNABLE MULTIBAND WAN ANTENNA FOR GLOBAL APPLICATIONS

BACKGROUND OF THE INVENTION

A mobile unit may (MU) be configured with a transceiver to communicate with a network. The transceiver is coupled to an antenna such that the transceiver is capable of connecting to the network on a particular operating frequency of the network. Accordingly, the antenna is designed to transmit/receive signals from the transceiver to the network on the operating frequency. For example, a cellular network in Europe is based upon a Global System for Mobiles (GSM) network utilizing a high-band frequency of 1900 MHz. In another example, a cellular network in the United States is based upon a Code Division Multiple Access (CDMA) network utilizing a high-band frequency of 1800 MHz. In yet another example, a low-band frequency ranging between 800-900 MHz may also be used such as in cellular networks. Therefore, the antenna allows the transceiver to operate on these frequencies.

A conventional MU may include a respective antenna for each operating frequency, thereby enabling the transceiver to transmit/receive signals in different networks. That is, the MU may include a first antenna to operate in the GSM network, a second antenna to operate in the CDMA network, and a third antenna to operate in the cellular network. However, this requires multiple antennas to be disposed within the housing of the MU, each antenna requiring respective connections/components.

In addition, the antenna may experience a variety of different factors that may detune the frequency at which the antenna is to operate. That is, the MU is generally not used such that there is no interference during use. FIG. 1A shows a first conventional manner of use for a MU and FIG. 1B shows a second conventional manner of use for the MU. Specifically, in a first use 10, the MU is raised to a user's head. In a second use 20, the MU is held in a user's hand. With either the first use 10 or the second use 20, the user creates an interference. Specifically, a detuning effect is present. FIG. 1C shows an effect on frequency from the conventional manners of use of the MU. A finger effect detuning graph 30 illustrates how the interference from the user affects the frequency with which the antenna operates.

FIG. 2A shows a conventional system 40 of a combined antenna 50 having a tuning element 60 as is known in the art. If a conventional combined antenna 50 includes multiple portions, the tuning element 60 is coupled to an end of the conventional combined antenna 50. As illustrating a coupling 70 may be utilized at the end such that the tuning element 60 is coupled. However, by coupling the tuning element 60 at the end of the conventional combined antenna 50, several drawbacks are presented.

FIG. 2B is a graph illustrating the frequencies of the conventional combined antenna 50 of FIG. 2A. As shown, operation of the conventional combined antenna 50 in the high-frequency band has significant shifts. Specifically, the energy usage (e.g., voltage) that runs through the conventional combined antenna 50 having the tuning element 60 at the end causes the high-frequency band operation to have adverse effects. The dark, solid line of the graph of FIG. 2B represents an operation in the high-frequency band when no interference is experienced. However, the use of the tuning element 60 disposed at the end of the combined conventional antenna 50 causes the operation lines to shift dramatically. That is, the high-frequency band operation from the use of the tuning element 60 creates significant disturbance therein. This is due to the long arm of the conventional combined antenna 50 in addition to the main operation frequency of the low band in which third harmonics operate at the high band. Coupling to this long arm at the end thereby affects both the low band and the high band.

Accordingly, there is a need for a combined antenna that is capable of operating in at least two high-band frequencies and a low frequency so that the combined antenna is capable of being used in global applications while also capable tuning the antenna to compensate for any detuning effect or guaranteeing that the antenna operates at a predetermined frequency.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1A:
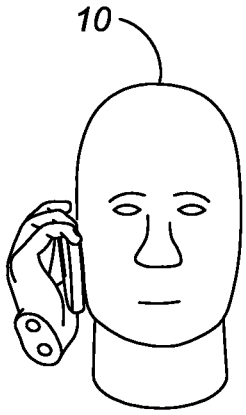
FIG. 1A PRIOR ART
FIG. 1A shows a first manner of use for a mobile unit as is known in the art.
Figure 1B:
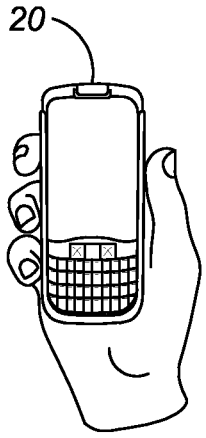
FIG. 1B PRIOR ART
FIG. 1B shows a second manner of use for a mobile unit as is known in the art.
Figure 1C:
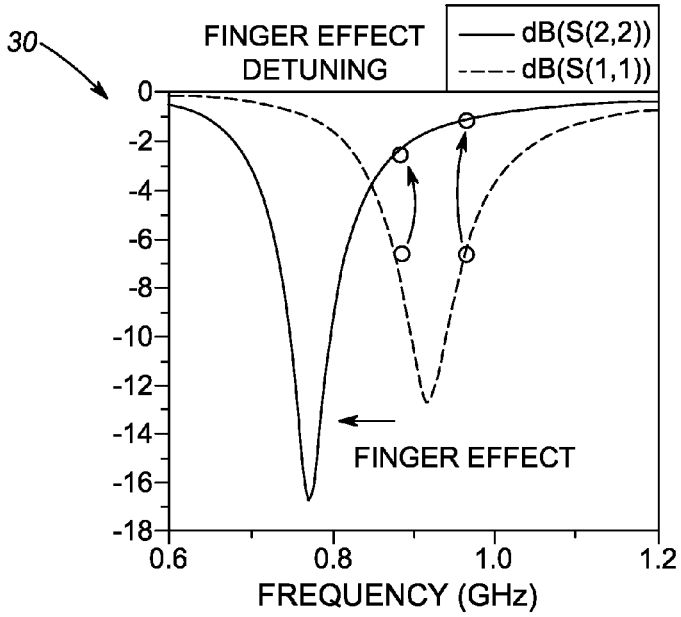
FIG. 1C PRIOR ART
FIG. 1C shows an effect on frequency from a user of a mobile unit as is known in the art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

An electronic device comprises a housing; a transceiver disposed within the housing; and an inverted F-antenna coupled to the transceiver, the antenna comprising an elongate element, a first portion coupled to a first end of the elongate element and configured to enable the transceiver to operate in a first low-band frequency and a first high-band frequency, a second portion coupled to a second end of the elongate element, the second end being opposite the first end, the second portion configured to enable the transceiver to operate in a second high-band frequency, and a third portion coupled to the elongate element and situated between the first and second portions, the third portion configured to tune operating frequencies associated with the first and second portions such that the transceiver operates in the first and second high-band frequencies, respectively.

The exemplary embodiments may be further understood with reference to the following description and the appended drawings, wherein like elements are referred to with the same reference numerals. The exemplary embodiments describe a combined antenna that includes a plurality of portions configured to enable the antenna to operate in a plurality of frequencies. Specifically, a first portion may be configured to operate in a first high-band frequency and a low-band frequency, a second portion may be configured to operate in a second high-band frequency, and a third portion may be configured to tune the high-band frequencies of the first portion and second portions. The exemplary embodiments also describe a tuning element coupled to the combined antenna such that the low-band frequency of the first portion may also be tuned. The tuning element may further fine tune the antenna to operate in a desired low-band frequency. The combined antenna, the portions, the high-band and low-band frequencies, and the tuning element will be discussed in further detail below.

Figure 3:
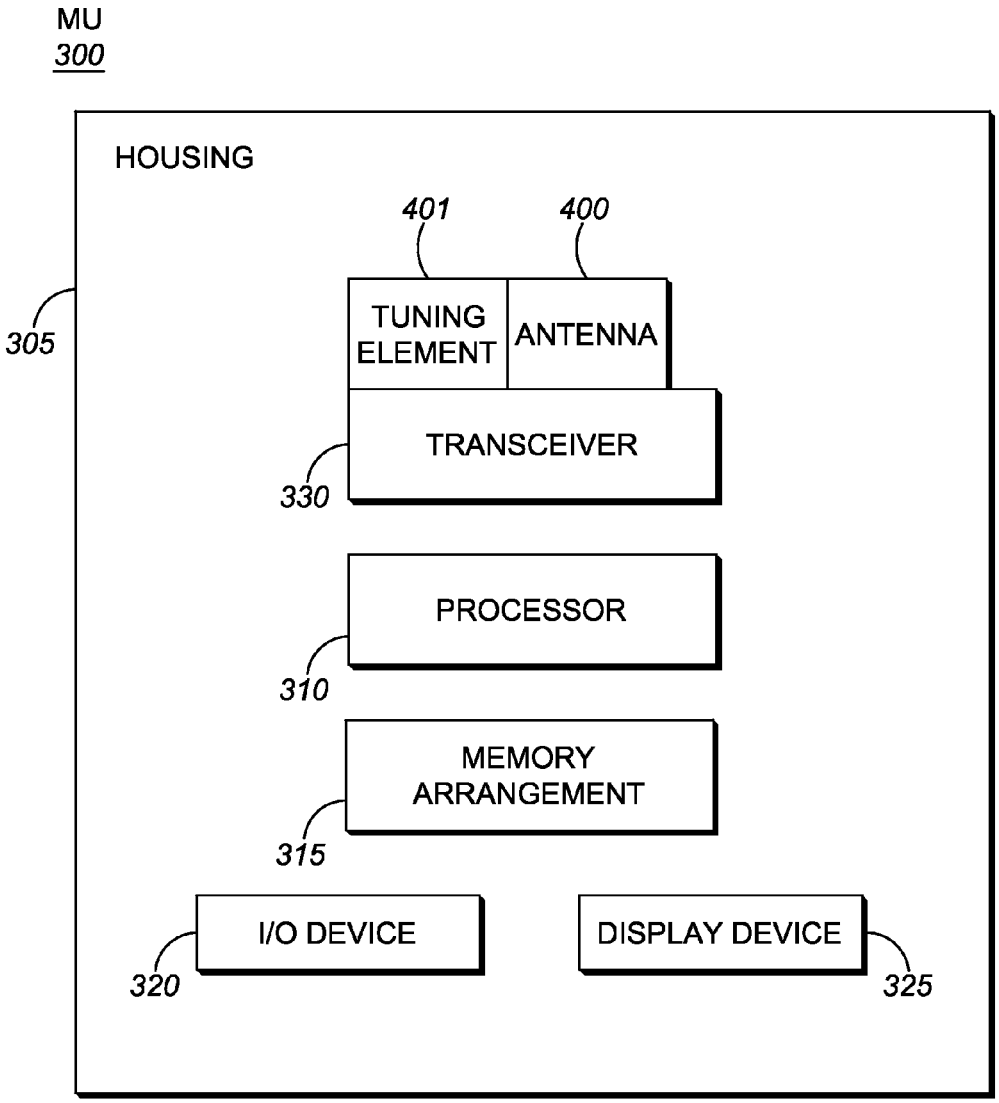
FIG. 3 shows a mobile unit including a combined antenna in accordance with some embodiments.

FIG. 3 shows a mobile unit (MU) 300 including a combined antenna 400 in accordance with some embodiments. The MU 300 may include a plurality of conventional components. For example, the MU 300 may include a housing 305 that at least partially houses a plurality of electronic components such as a processor 310, a memory arrangement 315, an input/output (I/O) device 320, a display device 325, and a transceiver 330. The transceiver 330 may be coupled to the combined antenna 400. It should be noted that the MU 300 may include further components. For example, the MU 300 may include coupling contacts to recharge a portable power supply disposed within the housing 305; an audio output component (e.g., a speaker); and audio input component (e.g., a microphone (not shown)); etc. According to a further exemplary embodiment, the MU 300 may include a tuning element 401. The tuning element 401 will be described in further detail below, particularly with regard to FIGS. 6A and 6B.

The MU 300 may be any electronic device configured to connect to a network. For example, the MU 300 may be a laptop, a cellular phone, a smartphone, a personal digital assistant, a tablet, etc. including the transceiver 330 that enables the MU 300 to transmit/receive data from the network via the combined antenna 400. In another example, the MU 300 may represent a stationary device (e.g., a terminal) including a wireless transceiver. Accordingly, it should be noted that the electronic device being the MU 300 is only exemplary. Those skilled in the art will understand that the combined antenna 400 may also be utilized in any electronic device such as the stationary device. The description below will discuss the electronic device being a MU.

In a specific exemplary embodiment, the housing 305 may be a shelter for an electromagnetic compatibility (EMC) new generation long term evolution (LTE) device having dimensions of 136 mm×69 mm×15.9 mm. As will be described in further detail below, the combined antenna 400 may support multiple bands including low-band frequencies utilized for cellular data such as 700 MHz, 850 MHz and 900 MHz, and high-band frequencies for personal communication services (PCS) such as 1800 MHz, 1900 MHz, and 2100 MHz. Accordingly, the combined antenna 400 enables the MU 300 to operate in a global manner by allowing the MU 300 including the combined antenna 400 to operate in a LTE network (for the United States) as well as a GSM network (for Europe). Also as will be described in further detail below, the combined antenna 400 may have a low-band efficiency of greater than 40% and a high-band efficiency of greater than 50% in a bandwidth based on a scattering parameter (S-parameter) of S11 (e.g., forward reflection, input-match of impedance) having less than −5 dB.

Figure 4A:
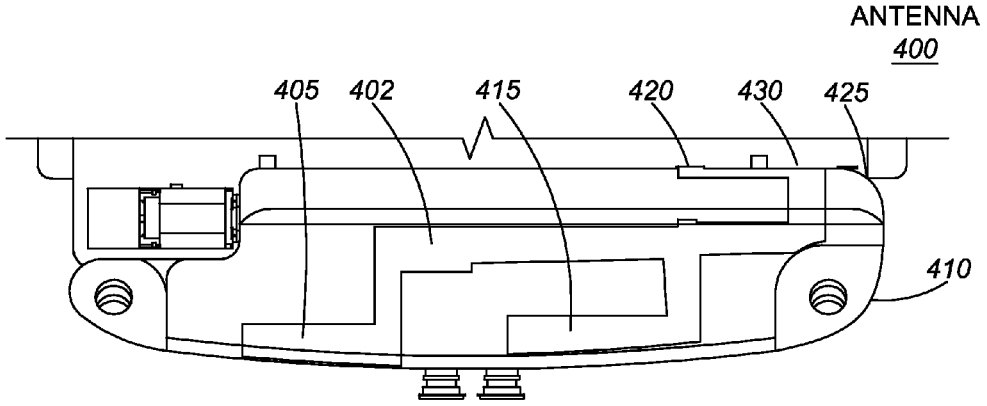
FIG. 4A shows a first view of the combined antenna of FIG. 3 in accordance with some embodiments.
Figure 4B:
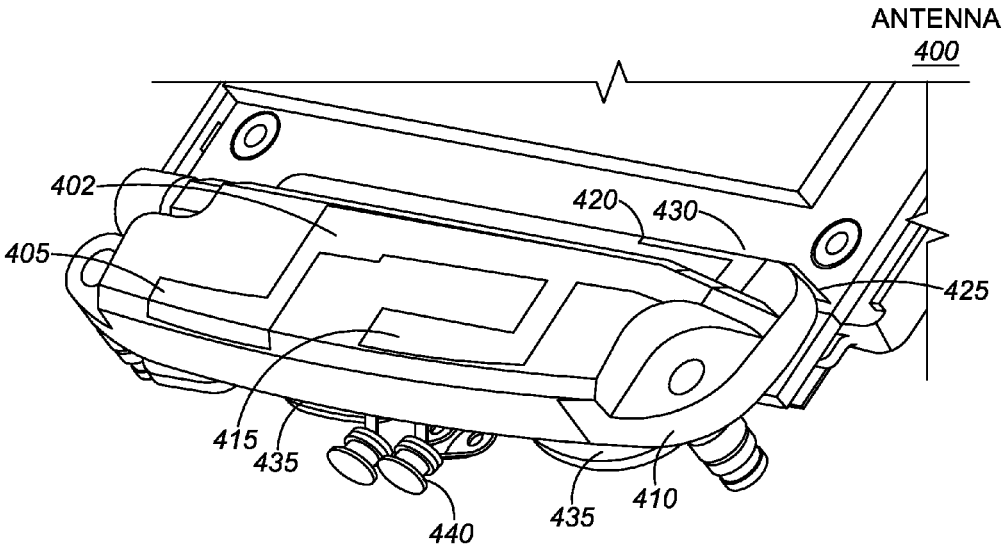
FIG. 4B shows a second view of the combined antenna of FIG. 3 in accordance with some embodiments.

FIGS. 4A and 4B show first and second views, respectively, of the combined antenna 400 of FIG. 3 in accordance with some embodiments. The perspective views of the combined antenna 400 of FIGS. 4A and 4B illustrates an exemplary disposition of the combined antenna 400 in relation to the components of the MU 300. The perspective views of FIGS. 4A and 4B further illustrate the MU 300 without the housing 305. Specifically, the combined antenna 400 may be disposed on an inner frame of the MU 300. However, it should be noted that the inner frame may also comprise at least a portion of the housing 305 such as the housing 305 including two parts joined together with the inner frame maintaining a side that is exposed to an exterior.

The combined antenna 400 may include a plurality of parts. Specifically, the combined antenna 400 may include an elongate element 402, a first portion 405, a second portion 410, and a third portion 415. According to an exemplary embodiment, the combined antenna 400 may be designed as an inverted F-antenna (IFA). In a specific exemplary embodiment, the combined antenna may be designed as an IFA antenna with a parasitic element for multi-band support where a differential mode is applied to a 1800/1900 transmission band for low specific absorption rate (SAR) and hearing aid compatibility (HAC). The combined antenna 400 may include a ground 420 and a parasitic ground 425 for the second portion 410 which is a parasitic arm. The combined antenna 400 may also be coupled to the transceiver via a feed 430. The first portion 405 may be designed to have a length corresponding to a ¼ wave in the low-band frequency to generate a low-band resonance. The second portion 410 may be designed to have a length corresponding to a ½ wave in the high-band frequency. However, as will be discussed in further detail below, the second portion 410 may operate at ¾ wave of the 2100 MHz band. The third portion 415 may be grounded via the ground 425.

The perspective views of FIGS. 4A and 4B further illustrate the disposition of the combined antenna 400 with respect to other components of the MU 300 in a specific exemplary embodiment. For example, the combined antenna 400 may be disposed on the inner frame (on a front panel for the first portion 405 and the third portion 415 and a side panel for the second portion 410). Also coupled to the inner frame may be audio output components 435 (e.g., speakers) and charging pins 440. The combined antenna 400 may be designed in a manner that these components are not affected in order to perform their respective functionalities. For example, the electromagnetic properties of the combined antenna 400 may be eliminated or minimized such that the other components properly function.

According to the exemplary embodiments, the combined antenna 400 may be configured to operate on a plurality of frequency bands. The combined antenna 400 may be designed such that the first portion 405, the second portion 410, and the third portion 415 are arranged in a predetermined manner. As illustrated in FIGS. 4A and 4B, the combined antenna 400 includes the elongate element 402 extending from the feed 430. The first portion 405 may be disposed as an arm extending from a far end of the elongate element 402 furthest from the feed 430. The third portion 415 may be disposed as an arm extending from a middle area of the elongate element 402, between the far end and a near end with respect to the feed 430. The first portion 405 and the third portion 415 may be disposed on a common front portion of the inner frame. The second portion 410 may be disposed as an arm extending from the near end of the elongate element 402 closest to the feed 430. Furthermore, the second portion 410 may be disposed on a side portion of the inner frame.

The first portion 405 may be configured to enable the transceiver 330 to operate on a first frequency. Specifically, the first portion 405 may enable the transceiver 330 to operate on a low-band frequency such as 900 MHz. The first portion 405 may further be configured to enable the transceiver 330 to operate on a second frequency. That is, the first portion 405 may be configured for the transceiver 330 to operate on two frequencies. Specifically, the first portion 405 may enable the transceiver 330 to operate on a high-band frequency such as 2100 MHz. The third portion 415 may be configured to enable the first portion 405 to operate on the second high-band frequency. That is, the third portion 415 may include a third internal resonance at 2.9 GHz which tunes the first portion 405 to the 2100 MHz band. The second portion 410 may be configured to enable the transceiver 330 to operate on a third frequency. Specifically, the second portion 410 may enable the transceiver to operate on a second high-band frequency such as 1800 or 1900 MHz. The third portion 415 may also be configured as a fine tuning element for both the first portion 405 and the second portion 410 such that the desired frequency band is utilized by the transceiver 330. Specifically, the fine tuning element of the third portion 415 is for both the first portion 405 and the second portion 410 for the respective resonance at the high-band. Therefore, the third portion 415 provides for the first portion 405 to operate on the low-band frequency and the high-band frequency while further providing a fine tuning for both the first portion 405 and the second portion 410 in the high-band frequency range. It should be noted that the third portion 415 has no resonance itself and is configured for tuning the high-band frequencies of the respective first portion 405 and the second portion 410.

Figure 5:
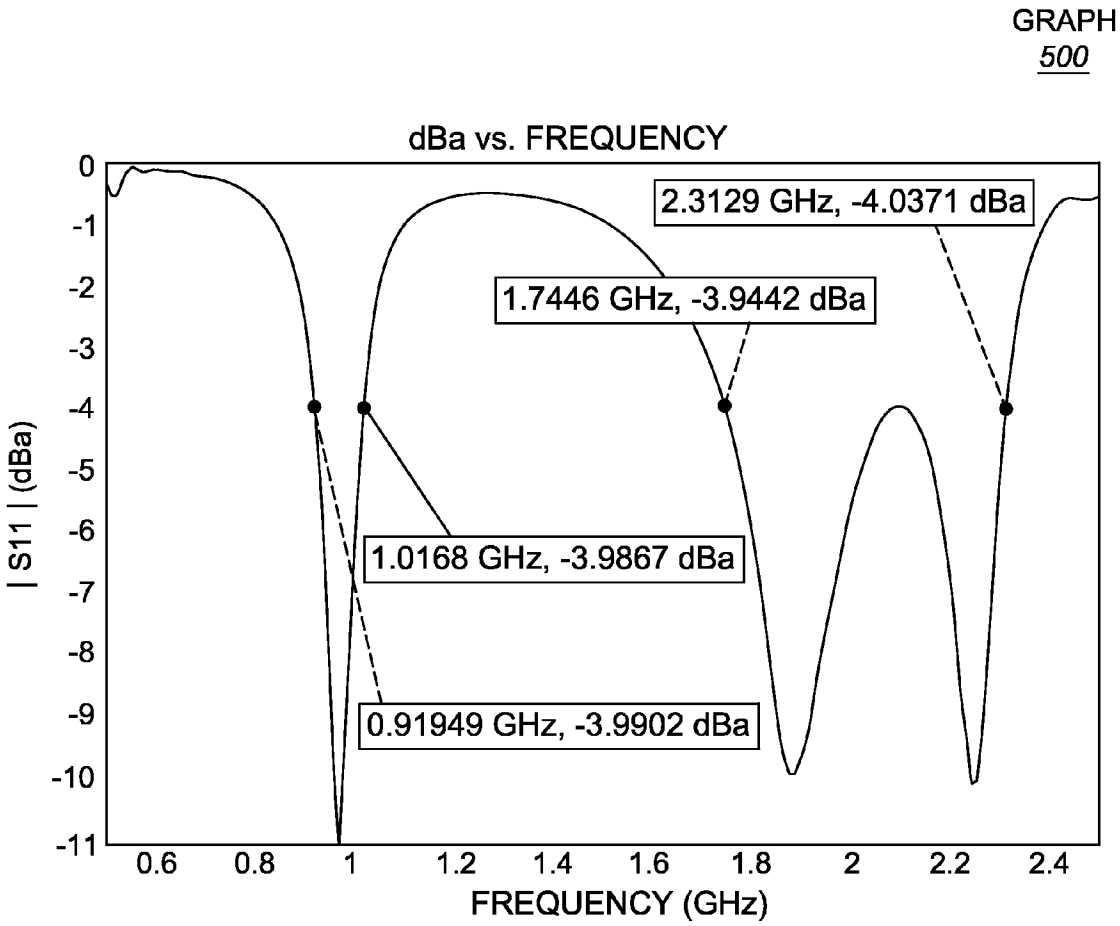
FIG. 5 is a graph of operating frequencies for the combined antenna of FIG. 4 in accordance with some embodiments.

FIG. 5 is a graph 500 of operating frequencies for the combined antenna 400 of FIGS. 4A and 4B in accordance with some embodiments. Specifically, the graph 500 relates to the combined antenna 400 operating with no interference. As illustrated, the first portion 405 enables the transceiver 330 to operate on a low-band frequency of 900 MHz and a high-band frequency of 2100 MHz via the tuning from the second portion 410. The second portion 410 enables the transceiver 330 to operate on a second high-band frequency of 1800 or 1900 MHz. The second portion 410 which is a parasitic arm provides the low HAC and SAR for regions such as Europe and the United States. The third portion 415 is used to fine tune the high band within the frequency of interest.

Figure 6A:
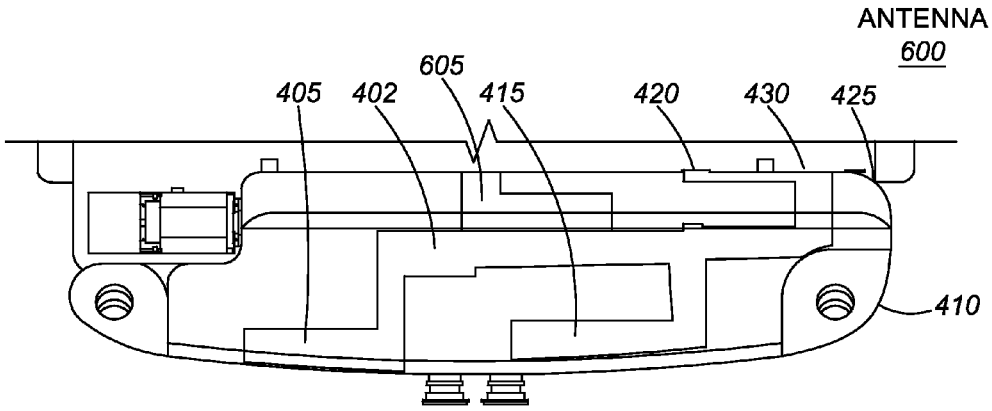
FIG. 6A shows a first view of a combined antenna having a tuning element in accordance with some embodiments.
Figure 6B:
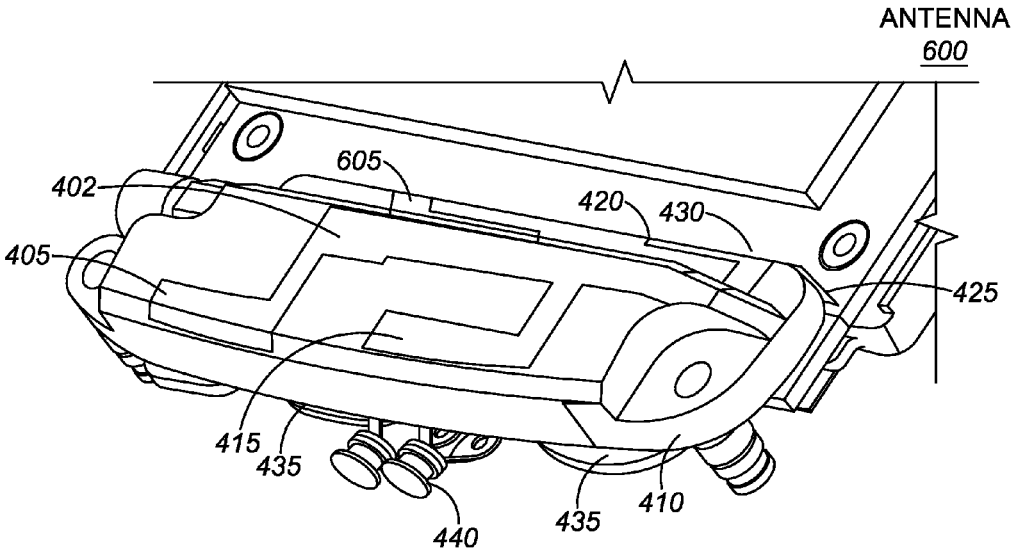
FIG. 6B shows a second view of a combined antenna having a tuning element in accordance with some embodiments.

According to the exemplary embodiments, the combined antenna 400 may further include the tuning element 401 such that the low-band frequencies may also be tuned for the transceiver 330. FIGS. 6A and 6B show first and second views, respectively, of a combined antenna 600 having a coupling 605 to the tuning element 401 in accordance with some embodiments. Specifically, the combined antenna 600 may include substantially the same components as the combined antenna 400 in addition to the coupling 605 and the tuning element 401. As illustrated in FIGS. 6A and 6B, the coupling 605 may be disposed in a middle position with respect to the elongate arm of the combined antenna 600. Specifically, the coupling 605 may be disposed extending opposite the third portion 415 with regard to the elongate element 402 of the combined antenna 600. The coupling 605 may be an inverted L-shape coupled to the combined antenna 600. According to a specific exemplary embodiment, the tuning element 401 that is coupled to the combined antenna 600 via the coupling 605 may be a digital tunable capacitor (DTC) or multiport switch (e.g., SP4T) having a capacitor at each radio frequency port connected to the combined antenna 600 before the ground.

The tuning element 401 may be configured to tune (e.g., fine tune) the first portion 405 such that the transceiver 330 is capable of operating at various different low-band frequencies. Specifically, the tuning element 401 may be configured to tune the first portion 405 such that the transceiver 330 operates at low-band frequencies between 700 and 900 MHz. That is, if operating at 900 MHz, the tuning element 401 may shift the frequency to 850 MHz, to 800 MHz, to 750 MHz, and to 700 MHz. By changing the DTC capacitance value or switch stages in the SP4T, the low-band frequency may be tuned up or down. In this manner, the combined antenna 600 is configured to operate in a global manner (e.g., Europe and United States) as the supported bands are substantially all covered. Specifically, the combined antenna 600 is configured such that the transceiver 330 operates at low-band frequencies of 700 MHz, 850 MHz, and 900 MHz (via the first portion 405 tuned by the tuning element 401) and high-band frequencies of 1800 MHz and 1900 MHz (via the second portion 410 tuned by the third portion 415) and 2100 MHz (via the first portion 405 tuned by the third portion 415).

As discussed above for a conventional tuning element disposed at a far end of the elongate element of a conventional antenna, the coupling of the conventional tuning element includes drawbacks, in particular from interference generated by the coupling to the high-band frequency. That is, the low-band frequency may be tuned by the conventional tuning element but at the cost of the efficiency and operability of the high-band frequencies. In contrast, the coupling 605 for the tuning element 401 being disposed as illustrated in FIGS. 6A and 6B substantially eliminates the drawbacks.

According to the exemplary embodiments, the coupling 605 is disposed in a substantially middle position with regard to the elongate element 402 of the combined antenna 600. Through placement of the coupling 605 in this disposition, the high-band frequencies suffer little to no effect from the coupling 605. Specifically, when tested under a quarter (¼) wave in common mode, the first portion 405 is tuned by the tuning element 401 such that the transceiver operates at a low-band frequency of 950 MHz. However, the coupling 605 of the tuning element 401 according to the exemplary embodiments prevents the adverse effects ordinarily associated with a conventional coupling.

The coupling 605 is disposed near a substantially middle position such that the coupling 605 is coupled at a high current area of the combined antenna 600 operating at a high-band frequency. The placement of the coupling 605 at this disposition prevents the high-band frequency to shift when the transceiver 330 is operating in a high-band frequency. Thus, the coupling 605 enables the low-band frequency to shift as desired via the tuning element 401 but maintains the high-band frequency operation. Accordingly, the high-band frequency operation is improved.

As discussed above for a conventional tuning element, the manner of use also affects the efficiency of the transceiver. The tuning element 401 may also be used in a substantially similar manner as the third portion 415 in that a fine tuning may also be performed for the low-band frequencies. Depending on the manner of use, the MU 300 may be utilized such that a detuning occurs. The tuning element 401 may be configured to fine tune the low-band frequency such that the head or hand impact on the low-band frequency operation is adjusted (e.g., automatically or manually).

Figure 2A:
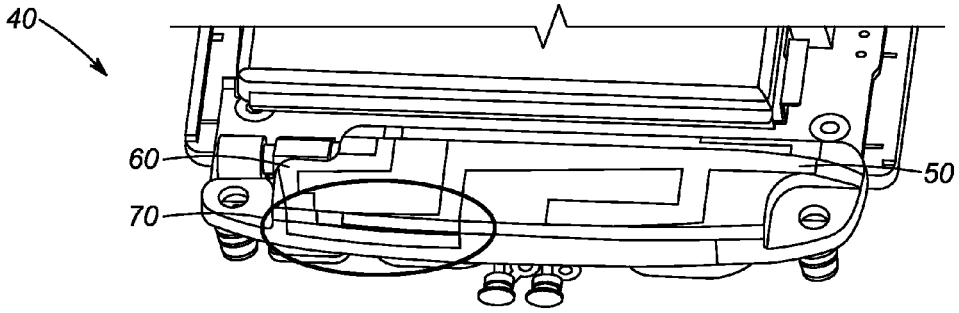
FIG. 2A PRIOR ART
FIG. 2A shows a system of a combined antenna having a tuning element as is known in the art.
Figure 2B:
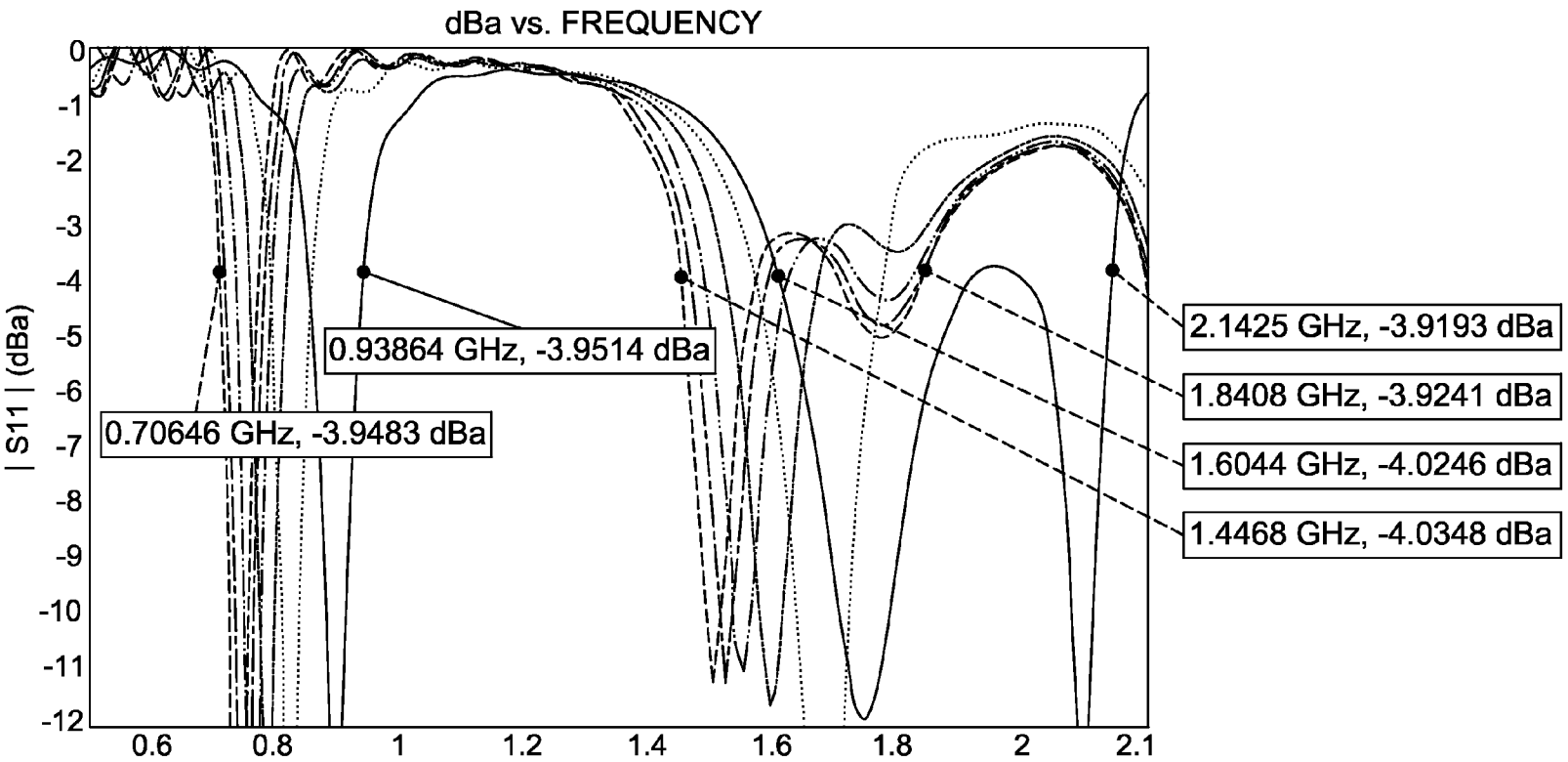
FIG. 2B PRIOR ART
FIG. 2B is a graph illustrating the frequencies of the combined antenna of FIG. 2A.
Figure 7:
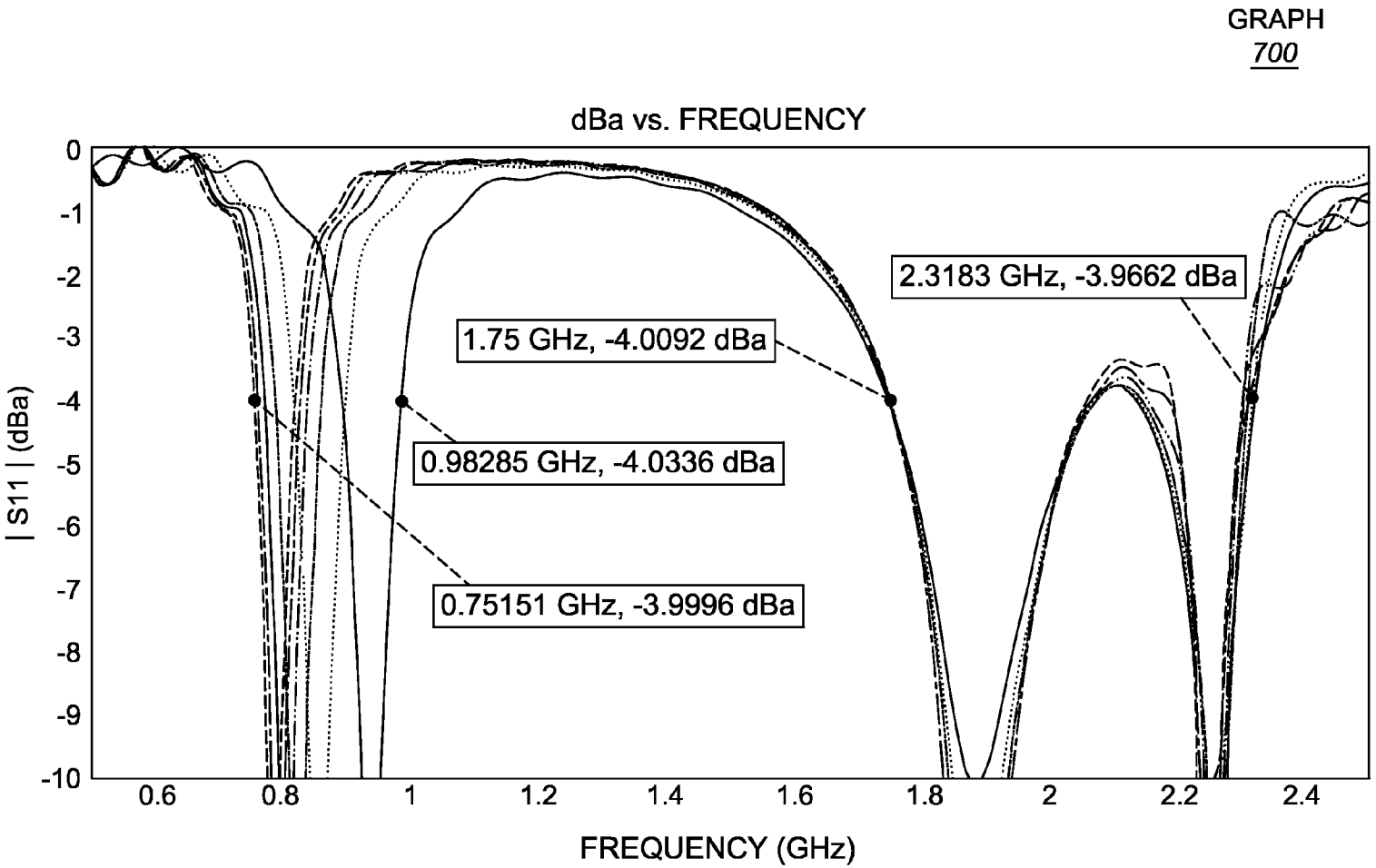
FIG. 7 is a graph of operating frequencies for the combined antenna having the tuning element of FIG. 6 in accordance with some embodiments.

FIG. 7 is a graph 700 of operating frequencies for the combined antenna 600 having the tuning element 401 and the coupling 605 of FIGS. 6A and 6B in accordance with some embodiments. As illustrated, the first portion 405 enables the transceiver 330 to operate at the low-band frequency between 700 to 900 MHz via the tuning provided by the tuning element 401. When coupling 605 is directly connected to the PCB ground, it operates at the highest frequency of the low band. Capacitors may be added with value from low to high between the coupling 605 and the PCB ground which shift the low band frequency lower to cover the LTE 700 band. On the other hand, because the coupling 605 is coupled in illustrated location (e.g., the high current area of the high band), no frequency detune at the high band occurs. The combined antenna 600 including substantially similar components as the combined antenna 400 also provides for the high-band frequency of 2100 MHz from the first portion 405 while a second high-band frequency of 1800 or 1900 MHz is achieved by the second portion 410. In contrast to the graph of FIG. 2B which illustrates the frequency shifts from the conventional coupling of the conventional tuning element, the graph 700 illustrates that the disposition of the coupling 605 according to the exemplary embodiments have little to no effect on the operation in the high-band frequencies.

According to the exemplary embodiments, the fine tuning of the third portion 415 and the tuning element 401 may be performed using known manners. In a first example, an open loop tuning may be performed. The open loop tuning is performed utilizing a look-up table. The look-up table may be stored in the memory arrangement 315 such that signals received from the transceiver 330 by the processor 310 may be used as a reference to determine an amount of tuning necessary based upon the data included in the look-up table. Specifically, the amount of tuning is based upon the network operating frequency. For example, a network operating frequency may be 1800 MHz for a high-band frequency. However, a shift in the frequency may occur from a variety of factors (e.g., finger effect). Therefore, to shift the frequency to the desired 1800 MHz, the look-up table provides an amount of tuning as a function of the signals received from the transceiver 330 which indicates the actual frequency that the transceiver 330 is operating due to the detuning factor. Those skilled in the art will understand that this method of tuning is easier with low processing requirements but may not be as accurate. In a second example, a closed loop tuning may be performed. The closed loop tuning is performed in a simultaneous and dynamic manner. Specifically, the closed loop tuning is performed as a function of feedback from the transceiver 330. For example, an amount of tuning may be applied to a detuned actual frequency and feedback from the transceiver 330 determines whether further tuning is required to reach the desired operating frequency of the network. Those skilled in the art will understand that this method of tuning is more complicated and requires more processing power as well as further components such as a detector and a macro-controller. However, this method may provide more accurate tuning.

Figure 8:
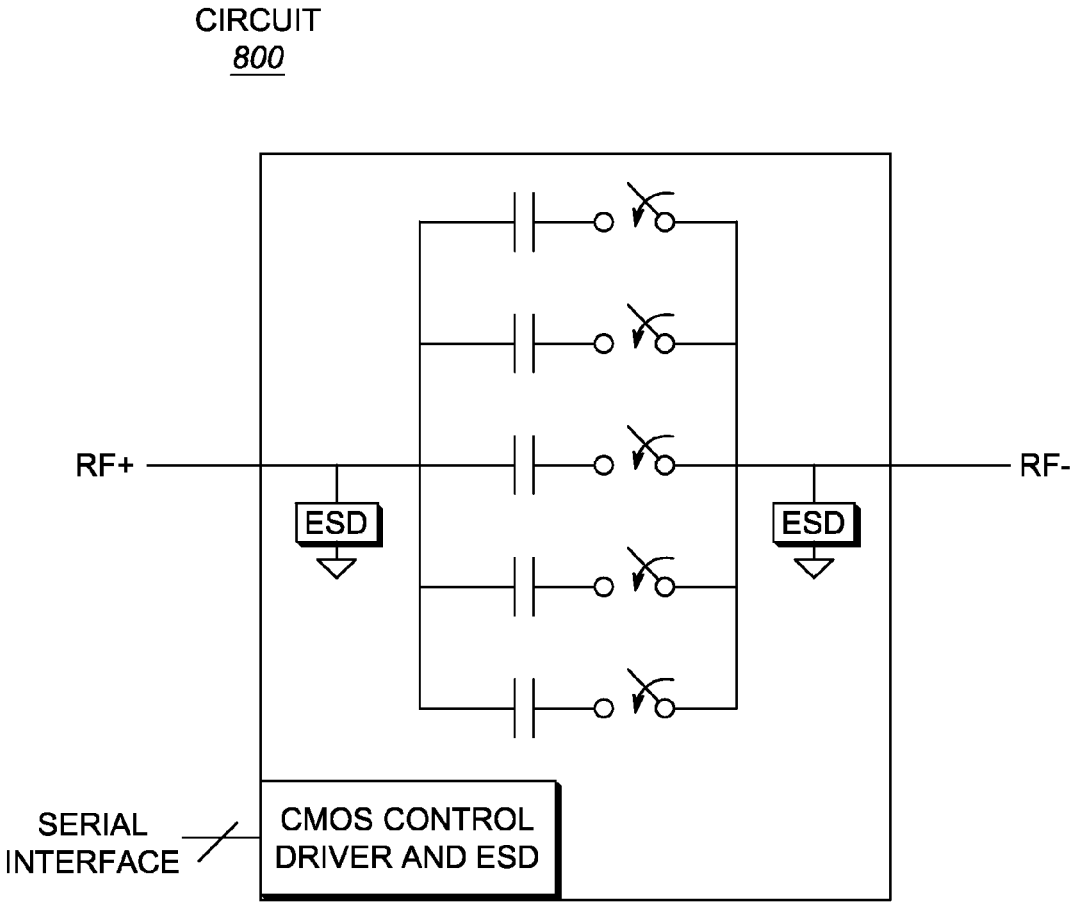
FIG. 8 is a circuit diagram of a first tuning element in accordance with some embodiments.
Figure 9:
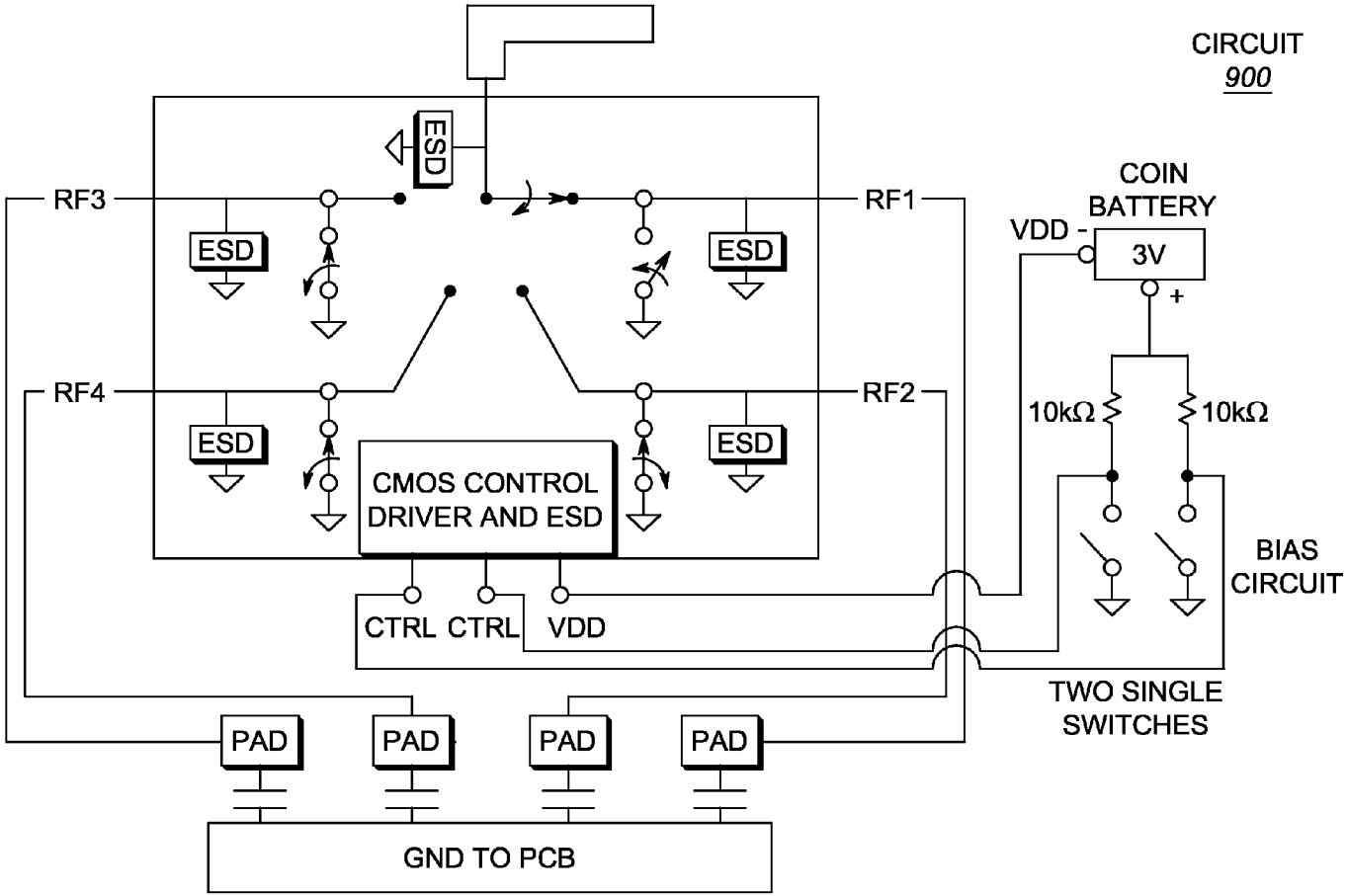
FIG. 9 is a circuit diagram of a second tuning element in accordance with some embodiments.

FIG. 8 is a circuit diagram 800 of a first tuning element in accordance with some embodiments. The circuit diagram 800 illustrates a first exemplary manner of providing the tuning element 401 discussed above. Specifically, the circuit diagram 800 is for when the tuning element 401 is configured as a DTC having a tuning range of 1 to 5 picofarads (pF). FIG. 9 is a circuit diagram 900 of a second tuning element in accordance with some embodiments. The circuit diagram 900 illustrates a second exemplary manner of providing the tuning element 401 discussed above. Specifically, the circuit diagram 900 is for when the tuning element 401 is configured as a SP4T in which each radio frequency (RF) port adds one capacitance value.

Figure 10:
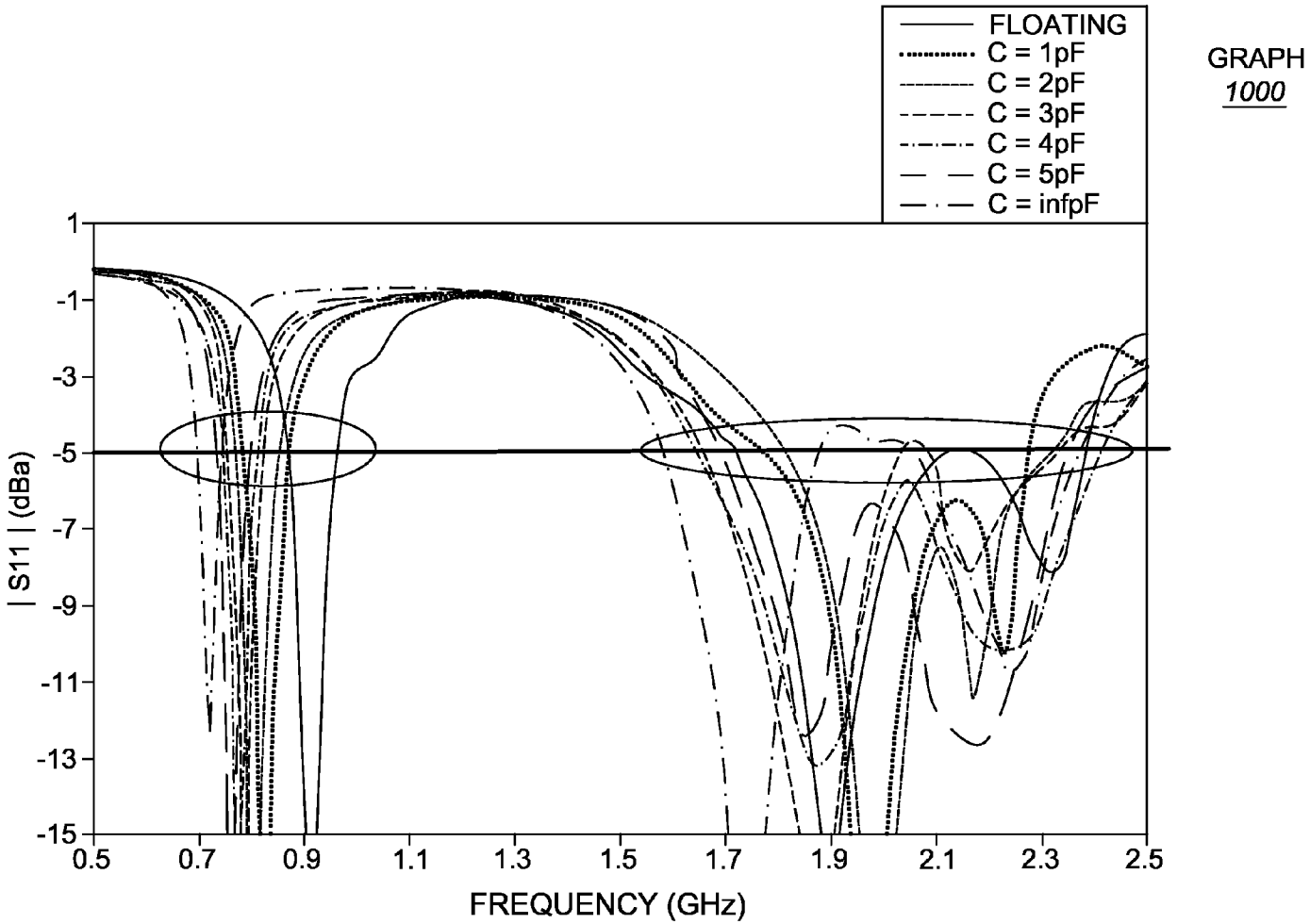
FIG. 10 is a graph of operating frequencies for the combined antenna having the tuning element of FIG. 6 in use for a sheltered device in accordance with some embodiments.

FIG. 10 is a graph 1000 of operating frequencies for the combined antenna 600 having the tuning element 401 of FIGS. 6A and 6B in use for a sheltered device in accordance with some embodiments. As shown, the tuning element 401 may be used such that the low-band frequencies may be shifted from 700 to 960 MHz. However, the shifting of the low-band frequencies has substantially no impact to the high-band frequency operation. The high-band frequency operation also covers the various network operating frequencies including 1800 MHz, 1900 MHz, and 2100 MHz. The graph 1000 also shows a baseline (black curve) in which no capacitor is applied to the tuning element 401. The further lines (dashed curves) show the effect when the capacitor is tuned between 1 to 5 pF and, in an extreme case, by grounding the tuning element 401 directly to a printed circuit board (PCB) of the MU 300.

Figure 11:
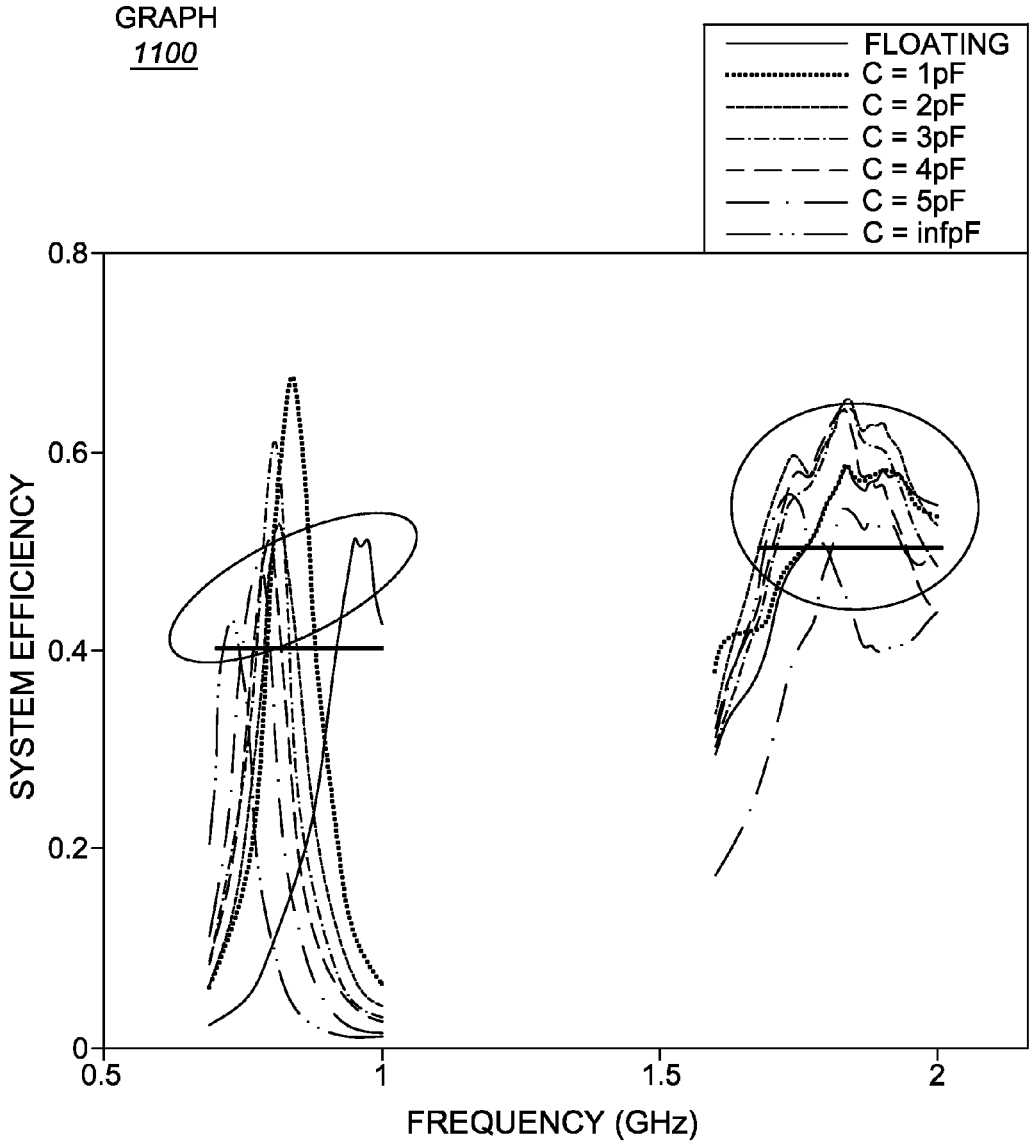
FIG. 11 is a graph of efficiency for the combined antenna having the tuning element of FIG. 6 in use for the sheltered device in accordance with some embodiments.

FIG. 11 is a graph 1100 of efficiency for the combined antenna 600 having the tuning element 401 of FIGS. 6A and 6B in use for the sheltered device in accordance with some embodiments. As discussed above, one objective of the present invention is to provide a combined antenna having a low-band efficiency of greater than 40% and a high-band efficiency of greater than 50%. The graph 1100 illustrates the use of the combined antenna 600 at the operating frequencies discussed above with regard to the graph 1000 of FIG. 10 in which the tuning element 401 is used with no capacitor, tuning the tuning element 402 from 1 to 5 pF, and with a ground to the PCB. The efficiency in the low-band frequency range of 700 MHz to 900 MHz has been found to be between 43% and 50%. The efficiency in the high-band frequency range of 1800 MHz to 2100 MHz has been found to be between 55% and 65%.

The exemplary embodiments provide a combined antenna that enables a transceiver to operate in a plurality of network operating frequencies. Specifically, the transceiver may operate in low-band frequencies between 700 to 900 MHz and high-band frequencies between 1800 to 2100 MHz. In this manner, a MU utilizing the combined antenna may be used in a global sense as network operating frequencies used in various regions are covered (e.g., Europe utilizing GSM and United States utilizing LTE). The combined antenna includes an elongate element in which a first portion is coupled thereto to enable the transceiver to operate in a low-band frequency (e.g., 900 MHz) and a high-band frequency (e.g., 2100 MHz). The combined antenna further includes a second portion coupled to the elongate element to enable the transceiver to operate in a further high-band frequency (e.g., 1800 or 1900

MHz). The combined antenna also includes a third portion coupled to the elongate element and disposed between the first and second portions that tunes the first and second portions in the high-band frequency (e.g., 1800, 1900, and 2100 MHz).

The exemplary embodiments further provide a combined antenna including a tuning element. The tuning element is coupled to the combined antenna via a coupling disposed in a substantially middle position of the elongate element of the combined antenna. The tuning element enables the low-band frequency to shift for the first portion. Accordingly, the tuning element enables the transceiver to operate in a plurality of low-band frequencies (e.g., 700 to 900 MHz). The disposition of the coupling has no substantial impact on the high-band frequency operation.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An electronic device, comprising:

a housing;

a transceiver disposed within the housing; and an inverted F-antenna coupled to the transceiver, the antenna comprising:

an elongate element;

a first portion coupled to a first end of the elongate element and configured to enable the transceiver to operate in a first low-band frequency and a first high-band frequency;

a second portion coupled to a second end of the elongate element, the second end being opposite the first end, the second portion configured to enable the transceiver to operate in a second high-band frequency;

a third portion coupled to the elongate element and situated between the first and second portions, the third portion configured to tune the first and the second high-band frequencies associated with the first and second portions; and a tuning element configured to tune the low-band frequency associated with the first portion such that the first and the second high-band frequencies are not significantly affected by tuning the tuning element.

2. The electronic device of claim 1, wherein the first low-band frequency is 900 MHz and the first high-band frequency is 2100 MHz.

3. The electronic device of claim 1, wherein the second high-band frequency is one of 1800 and 1900 MHz.

4. The electronic device of claim 1, further comprising:

a coupling configured to couple the tuning element to the antenna, the coupling having an inverted L-shape and disposed in a substantially central location of the elongate element of the antenna.

5. The electronic device of claim 4, wherein the central location is opposite the third portion with respect to the elongate element.

6. The electronic device of claim 4, wherein the central location is a high current area when the transceiver is operating in the first high-band frequency.

7. The electronic device of claim 4, wherein the tuning element is one of a digital tunable capacitor and a multiport switch.

8. The electronic device of claim 4, wherein the tuning element tunes the first low-band frequency to reach a second low-band frequency.

9. The electronic device of claim 8, wherein the second low-band frequency is one of 700 MHz and 850 MHz.

10. The electronic device of claim 4, wherein the third portion is configured to fine tune the operating frequencies associated with the first and second portions and the tuning element is configured to fine tune the operating frequencies of the first portion such that a detuning effect is substantially removed.

11. An inverted F-antenna for a wireless electronic device, comprising:

an elongate element;

a first portion coupled to a first end of the elongate element and configured to enable a transceiver of the electronic device to operate in a first low-band frequency and a first high-band frequency;

a second portion coupled to a second end of the elongate element, the second end being opposite the first end, the second portion configured to enable the transceiver to operate in a second high-band frequency;

a third portion coupled to the elongate element and situated between the first and second portions, the third portion configured to tune the first and the second high-band frequencies associated with the first and second portions; and a tuning element configured to tune the low-band frequency associated with the first portion such that the first and the second high-band frequencies are not significantly affected by tuning the tuning element.

12. The antenna of claim 11, wherein the first low-band frequency is 900 MHz and the first high-band frequency is 2100 MHz.

13. The antenna of claim 11, wherein the second high-band frequency is one of 1800 and 1900 MHz.

14. The antenna of claim 11, further comprising:

a coupling configured to couple the tuning element to the antenna, the coupling having an inverted L-shape and disposed in a substantially central location of the elongate element of the antenna.

15. The antenna of claim 14, wherein the central location is opposite the third portion with respect to the elongate element.

16. The antenna of claim 14, wherein the central location is a high current area when the transceiver is operating in the first high-band frequency.

17. The antenna of claim 14, wherein the tuning element is one of a digital tunable capacitor and a multiport switch.

18. The antenna of claim 14, wherein the tuning element tunes the first low-band frequency to reach a second low-band frequency.

19. The antenna of claim 18, wherein the second low-band frequency is one of 700 MHz and 850 MHz.

20. An antenna, comprising:

a first portion configured to enable a transceiver to operate in a first low-band frequency and a first high-band frequency;

a second portion configured to enable a transceiver to operate in a second high-band frequency;

a third portion configured to tune operating frequencies associated with the first and second portions such that the transceiver operates in the first and second high-band frequencies, respectively;

a tuning element configured to tune the low-band frequency associated with the first portion such that the first and the second high-band frequencies are not significantly affected by tuning the tuning element; and a coupling configured to couple the tuning element to the antenna, the coupling having an inverted L-shape and disposed in a substantially central location of the antenna.

* * * * *